United States Patent [19]

Tsumadori et al.

[11] Patent Number: 4,842,760

[45] Date of Patent: Jun. 27, 1989

[54] SOFT FINISHING AGENT

[75] Inventors: Masaki Tsumadori; Kazuo Shimizu; Junichi Inokoshi; Moriyasu Murata, all of Utsunomiya, Japan

[73] Assignee: Kao Corporation, Tokyo, Japan

[21] Appl. No.: 196,546

[22] Filed: May 20, 1988

[30] Foreign Application Priority Data

May 26, 1987 [JP] Japan ..... 62-129552

[51] Int. Cl.[4] ..... D06M 13/46

[52] U.S. Cl. ..... 252/8.8; 252/8.6; 252/547

[58] Field of Search ..... 252/8.6, 8.8, 547

[56] References Cited

U.S. PATENT DOCUMENTS

| | | | |
|---|---|---|---|
| 3,625,891 | 12/1971 | Waldman et al. | 252/8.8 |
| 3,904,359 | 9/1975 | Ramachandran | 252/8.8 |
| 3,958,059 | 5/1976 | Diehl | 252/8.8 |
| 4,417,995 | 11/1983 | Lips et al. | 252/547 |
| 4,589,989 | 5/1986 | Müller et al. | 252/8.8 |
| 4,622,154 | 11/1986 | Butterworth et al. | 252/8.8 |
| 4,642,258 | 2/1987 | Majewski et al. | 252/8.8 |
| 4,643,919 | 2/1987 | Fu | 252/8.8 |
| 4,661,270 | 4/1987 | Grandmaire et al. | 252/8.8 |
| 4,701,268 | 10/1987 | Nelson et al. | 252/8.8 |
| 4,772,403 | 9/1988 | Grandmaire et al. | 252/8.8 |

*Primary Examiner*—Paul Lieberman
*Assistant Examiner*—Helene Kirschner
*Attorney, Agent, or Firm*—Oblon, Spivak, McClelland, Maier, & Neustadt

[57] ABSTRACT

A soft-finishing agent comprising specific type of di-long-chained quaternary ammonium salt is disclosed. The quaternary ammonium salt has two long-chained alkyl or alkenyl groups which have specified average carbon numbers and are derived from naturally occurring oils or fats. The soft finishing agent can provide flexibility and antistaticity to various kinds of cloth, without impairing its water adsorption capability.

5 Claims, No Drawings

SOFT FINISHING AGENT

BACKGROUND OF THE INVENTION

1. Field of the Invention:

This invention relates to a soft finishing agent, and, more particularly, to a soft finishing agent which is capable of providing fibers with an excellent flexibility, and antistatic and water adsorption properties.

2. Description of the Background:

Cloth becomes hardened and loses its pleasant softness, as it is repeatedly worn and washed, due to the loss of fiber treatment agents through washing or to deterioration of the fibers themselves. Because of this, the tendency has increased in recent years among quite a few families to use more and more soft finishing agents which can reinduce the flexibility and antistatic property into fibers.

Most of the soft finishing agents for household use currently on the market are those containing, as a major component, a cationic active agent having one or two long-chained alkyl groups in a molecule, and specifically, among other things, di(hydrogenerated tallow oil-derived alkyl) dimethylammonium salt.

This quaternary ammonium salt, when used even in a small amount, can provide various fibers with good flexibility and antistatic effects. This flexibility is exhibited by a reduced friction coefficient on the fiber surface, which is caused by a lubrication effect of the hydrophobic part of the substrate compound molecule, the quaternary ammonium salt, absorbed onto the fiber surface. Therefore, the hydrophobic characteristic is considered to be essential for a soft finishing agent to be capable of providing an excellent softening effect. Ths hydrophobic characteristic, however, causes cloth to become water repellent and decreases its water adsorption capability. The decrease in water adsorption capability is particularly remarkable when the soft finishing agent is used at a high concentration.

In view of this situation, a number of studies have been conducted to promote the water adsorption capability of soft finishing agents. Thus, the use of a branched alkyltype quaternary ammonium salt (U.S. Pat. No. 3,377,382 and U.S. Pat. No. 3,395,100), and an imidazolinium compound derived from oleic acid [J. American Oil Chemical Society, 61, 367, (1984)], have, heretofore, been reported.

These compounds exhibit a sufficient effect concerning water adsorption. Their softening capability, however, is clearly inferior to that of the above-mentioned di(hydrogenated tallow oil-derived alkyl) dimethylammonium salt. In order to supplement this insufficient softening capability, the imidazolinium compound is conventionally used together with di(hydrogenated tallow oil-derived alkyl) dimethylammonium chloride, an imidazolinium compound derived from hydrogenated tallow oil, or the like. Inclusion of these compounds, however, brings about insufficent water adsorption capability. In the case of the above-mentioned $\alpha$- or $\beta$-branched alkyl-type quaternary ammonium salt, use of linear alkyl-type quaternary ammonium salt in conjunction with the $\alpha$- or $\beta$-branched alkyl-type quaternary ammonium salt, is proposed [Japanese Patent Laid-open Nos. 69998/1974, 53694/1975, 144174/1973, U.S. Pat. No. 3,892,669, and German Pat. No. 2,625,945]. These products are insufficient in their softening capability, however, and none of them has been successful in providing a completely satisfying soft finishing agent.

In view of this situation, the present inventors have undertaken extensive studies for the purpose of developing a soft finishing agent which can provide a satisfactory softening capability and a good antistatic effect, without impairing the water absorption or retention capability of the treated cloth. As a result, the inventors have found that certain di-long-chained quaternary ammonium salts having specific characteristics can satisfy this requirement. This finishing has led to the completion of this invention.

SUMMARY OF THE INVENTION

Specifically, an object of this invention is to provide a soft finishing agent comprising the following di-long-chained quaternary ammonium salts (A) or (B):

(A) di-long-chained quaternary ammonium salt which is represented by formula (I):

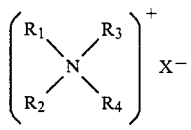

(I)

(in which $R_1$ and $R_2$ independently represent alkyl groups having an average carbon atom content of 10–24 and are derived from a naturally occurring oil or fat, provided that at least $R_1$ or $R_2$ have an average carbon atom content of not less than 14, $R_3$ and $R_4$ independently represent alkyl or hydroxy alkyl groups each having an average carbon atom content of 1–3, benyl groups, or groups represented by $-(C_2H_4O)_nH$, wherein n denotes an integer of 1–3, and X represents a halogen or an alkyl sulfate having a carbon atom content of 1–3), and of which 5% by weight aqueous dispersion has a gel-liquid crystal transition point of not more than 20° C., or (B) di-long-chain quaternary ammonium salt which is represented by formula (II):

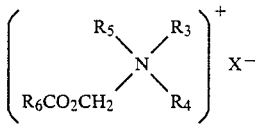

(II)

in which $R_5$ and $R_6$ independently represent alkyl or alkenyl groups having an average carbon atom content of 10–40, provided that at least $R_5$ and or $R_6$ have an average carbon atom content of not less than 16, $R_3$, $R_4$ and X have the same meanings as defined in formula (I)), and of which 5% by weight aqueous dispersion has a gel-liquid crystal transition point of not more than 30° C.

DETAILED DESCRIPTION OF THE INVENTION AND PREFERRED EMBODIMENTS

Among the di-long-chained quaternary ammonium salts used in this invention those represented by formula (I) are derived from naturally occurring oils or fats. Alkyl groups contained in such naturally occurring oils or fats have certain distributions, and compositions of such alkyl groups obtained from these oils or facts vary depending on the distillation conditions employed. Accordingly, di-long-chained quaternary ammonium salts derived from such naturally occurring oils or fats are mixtures of quaternary ammonium salts having varied alkyl chains, and they have varied properties as well. For the di-long-chained quaternary ammonium salts of formula (I) to be usable in this invention, however, it is necessary that a 5% by weight aqueous dispersion of one type of this compound, or the mixture of two or more types, has a gel-liquid crystal transition point of not more than 20° C., and desirably of 0°-15° C.

A naturally occurring oil or fat such as rapeseed oil, fish oil, tallow oil, perm oil, perm kernel oil, coconut oil, or the like are used as a row material. The di-long-chained quaternary ammonium salts of this invention can be prepared, for instance, by reacting a primary amine derived from a naturally occurring oil or fat with a long-chained alcohol in the presence of a hydrogenation catalyst and under a hydrogen pressure of 1-10 atm, to convert the primary amine into the secondary amine, followed by conversion of of this secondary amine into a quaternary amine. When $R_3$ are not identical, the secondary amine is first converted into a tertiary amine and then into a quaternary amine.

Here, the primary amine is obtained from a fatty acid which is derived from a naturally occurring oil or fat through nitrile. The long-chained alcohol, on the other hand, is obtained by hydrogenating a lower alkyl fatty acid ester which is derived from a naturally occurring oil or fat. A di-long-chained quaternary ammonium salt satisfying the above-mentioned characteristics can be obtained, using, as raw materials, a primary amine and a long-chained alcohol with a suitable alkyl-chain distribution, which are obtained through distillation to collect factions of these compounds having an appropriate alkyl-chain distribution. A suitable di-long-chained quaternary ammonium salt satisfying the required characteristics can easily be obtained by using a primary amine and a long-chained alcohol derived from different types of naturally occurring oils or fats, and particularly when the average number of carbon atoms contained in $R_1$ and $R_2$ differs 2 or more, and optimally 3 or more. Here, it is desirable that either $R_1$ or $R_2$ be an alkyl group derived from hydrogenated coconut oil and the other be an alkyl group derived from hydrogenated tallow oil, hydrogenated rapeseed oil, or hydrogenated fish oil.

The quaternarization reaction of the secondary or tertiary amine can be conducted, for example, when methyl chloride is used as a quaternarization agent, by using water and/or isopropyl alcohol as a solvent, and soda ash or caustic soda as an alkali, introducing methyl chloride into an autoclave at a temperature of 100°-110° C., and reacting the secondary or tertiary amines and methyl chloride for several hours. After completion of the reaction, the sodium chloride by-produced is removed by filtration to obtain a di-long-chained quaternary ammonium salt of this invention as a solution in water and/or ispropyl alcohol.

The di-long-chained quaternary ammonium salts of formula (II) have a gel-liquid crystal transition point of not more than 30° C., and desirably of 0°-20° C. These quaternary ammonium salts can be prepared, for example, by reacting chloroacetic acid and a higher alcohol by heating under dehydration conditions at a temperature of 120°-180° C. to obtain chloroacetic acid ester, and by reacting the chloroacetic acid ester thus obtained with a mono-long-chained alkyl tertiary amine in acetone under refluxing. (The mono-long-chained alkyl tertiary amine used in the latter reaction is obtained by the reaction of dimethyl amine and a higher alcohol in the presence of a metallic catalyst under a hydrogen pressure of 1-10 atm.) After the reaction, the reaction mixture is cooled and the target quaternary ammonium salt is collected in the form of white crystals. Alternatively, the quaternarization reaction may be carried out in the absence of a solvent, in which case isopropyl alcohol or water is added to obtain the target product as a solution.

In this process of preparing the di-long-chained quaternary ammonium salt of formula (II), it is desirable to obtain a higher alcohol with a suitable alkyl-chain distribution, by subjecting the raw higher alcohol to distillation to collect the fraction having the intended alkyl-chain distribution, and to use this fraction for preparing the quaternary ammonium salt.

Naturally occurring oils or fats are used as a raw material for $R_5$ and $R_6$ which constitute the di-long-chained quaternary ammonium salts of formula (II). Alkyl groups contained in such naturally occurring oils or fats have certain distributions, and compositions of alkyl groups obtained from these oils or fats vary depending on the distillation conditions employed. Accordingly, the resulting di-long-chained quaternary ammonium salts are mixtures of quaternary ammonium salts having varied alkyl chains, and they have varied properties as well.

The desirable type of quaternary ammonium salt (II) can be easily prepared, when $R_5$- and $R_6$- groups in formula (II) have different carbon atom contents from each other, particularly when the average carbon atom contents of $R_5$ and $R_6$ differ more than 3. The optimum characteristics of the di-long-chained quaternary ammonium salts of formula (II) can be realized when the $R_5$- and $R_6$- groups are saturated linear alkyl groups derived from a naturally occurring oil or fat such as rapeseed oil, fish oil, tallow oil, perm oil, perm kernel oil, coconut oil, or the like. The the soft finishing agent of the present invention can exhibit an excellent softening capability where at least either $R_5$ or $R_6$ has an average carbon atom content above 16, preferably above 20. It is desirable that either $R_5$ or $R_6$ be an alkyl group derived from hydrogenated coconut oil and the other be an alkyl group derived from hydrogenated tallow oil, hydrogenated rapeseed oil, or hydrogenated fish oil. Chloroacetic acid ester or mono-long-chained alkyl tertiary amines, which are intermediate products of the quaternary ammonium salt (II), may be used either as they are or after distillation to eliminate impurities.

The soft finishing agent of this invention can be made into various forms depending on the purposes toward which this product is directed. For example, it may be a fluid, powder, or spray (aerosol), or it can be impregnated into cloth, non-woven cloth, paper towels, or the like. The amount of the di-long-chained quaternary ammonium salt to be formulated into the soft finishing agent of this invention varies depending on the form in which it is to be used. When it is dispersed in water, the amount to be formluated is usually 3-20% by weight (hereinafter designated simply as "%"). At this instance, the particle size distribution of the dispersed substance should be desirably be such that the content of the particles having a size below 5 $\mu$ is 90% or more. A particle size distribution outside this range is not desirable because such would impair the softening property of the product.

To the soft finishing agent prepared according to the present invention, a cationic-type softening substrate can be used in conjunction with the di-long-chained quaternary ammonium salt of formula (I), inasmuch as the effect of this invention is not impaired, specifically, to the extent that the gel-liquid crystal transition point of the mixture does not exceed 20° C.

The following compounds (a)–(d) can be given as examples of such cationic-type softening substrates:

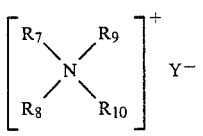
(a)

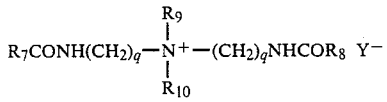
(b)

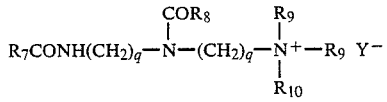
(c)

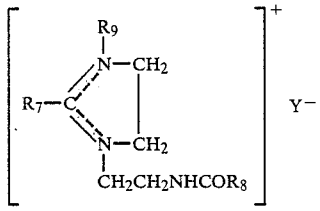
(d)

(in the formulae, $R_7$ and $R_8$ independently represent alkyl groups, alkenyl groups, or $\beta$-hydroxyalkyl groups, each having 10–24 carbon atoms, $R_9$ and $R_{10}$ independently represent hydrogen atom, alkyl or hydroxylalkyl groups each having an carbon atom content of 1–3, benzyl groups, or groups represented by $-(C_2H_4O)_nH$, wherein n denotes an integer of 1–3, and Y represents a halogen or an monoalkyl sulfate having a carbon atom content of 1–3).

When a mono-long-chained alkyl amine and/or higher alcohol is formulated into the soft finishing agent of this invention using the quarternary ammonium salt of formula (II), in an amount of 0.2–15%, desirabley 1–5%, the water absorption capability is remarkably promoted without impairing the flexiblity even if the agent is used at a low concentration.

Mono-long-chained alkyl amines usable for this purpose are those having the following structure:

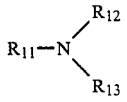
(III)

wherein $R_{11}$ represents an alkyl group having carbon atoms of 10–24, preferably 16–22, and $R_{12}$ and $R_{13}$ independently represent an alkyl group having carbon atoms of 1–3. The desirable higher alcohols are those containing 10–24, preferably 10–18 carbon atoms.

In addition to the cationic softening substrate, various ingredients may be formulated into the soft finishing agent of this invention. Such ingredients may include, for example, amines such as alkyl amine, alkyl ether amine, and the like; nonionic surface active agents such as polyoxyethylene alkyl ether, polyoxyethylene alkylphenyl ether, Pluronic type surface active agent, polyoxyethylene adduct of sorbitol, mono- or di-glyceride of higher fatty acid, polyoxydiethylene adduct of higher fatty acid, and the like; synthetic anionic surface active agents such as alkylbenzenesulfonic acid, salts of alkylsulfate ester, and the like; water-soluble inorganic salts such as sodium chloride, ammonium chloride, magnesium chloride, and the like; and solvents such as isopropyl alcohol, propylene glycol, ethylene glycol, and the like.

Furthermore, beside these ingredients, urea, bactericide, an antioxidant, pigment or dye for improving the outward appearence of the product, fluorescent whitening agent for enhancing the whiteness of the treated cloth, and perfume for providing a pleasant smell during and after the product use, may be optionally formulated.

The soften finishing agent prepared according to this invention is capable of providing flexibility and antistaticity to various kinds of cloth, without impairing its water absorption capability.

Other features of the invention will become apparent in the course of the following description of the exemplary embodiments which are given for illustration of the invention and are not intended to be limiting thereof.

EXAMPLES

In the following examples, measurement of gel-liquid crystal transition points, and evalution of flexibility and water absorption capability were conducted according to the following method.

(Measurement of gel-liquid crystal transition points)

Softening agents dispersed in ion-exchanged water at a concentration of 5% were used as samples. The samples were subjected to a thermal analyzer SSC/580 Series DSC 10, manufactured by Seiko Electronics Industries Co., Ltd. The temperature at which the heat absorption of a sample start to rise toward the peak was taken as the gel-crystal transition point of the same. Details of the measurement were as follows:

Ten (10) mg of a sample was taken into a 15 μl sealed sample container made of aluminum. An empty container of same type was used as a contol. The containers were cooled to −30° C. and then heated at a constant rate of temperature rise of 0.5°–1.0° C./min. The measurement was taken in the temperature range of 0°–60° C., and the temperature at which the heat absorption of a sample started to rise toward a peak was taken as the gel-crystal transition point of the sample. When two or more peaks were observed within this 0°–60° C. range, the highest of such points was taken as the gel-crystal transition point.

(Evaluation)

(1) Method of Softening Treatment

A commercially available cotton towel was repeatedly washed five times with a commercial detergent (Zab: Trade Name manufactured by Kao Corporation). After removing the attached detergent, the towel was treated with a 0.1% aqueous (hard water of 3.5° DH) solution of the soft finishing agent at 25° C. and a bath ratio of 1/30 while stirring.

(2) Method of Evaluation

The cloth treated by this method was air dried in an atmosphere and then left in a room with a constant temperature of 25° C. and pressure of 65% RH for 24 hours. The flexibility and water adsorption of the cloth were then evaluated.

(i) Flexibility

Cloth treated with di(hydrogenated tallow oil-derived alkyl) dimethylammonium chloride (Composition No. 15 in Table 1) was used as a control to evaluate the other compositions on a one-by-one basis. The following standard was adopted for the evaluation:

| | |
|---|---|
| +2 | The tested composition produces a better flexibility than the control |
| +1 | The tested composition produces a slightly better flexibility than the control |
| 0 | The tested composition produces a flexibility of the same degree as the control |
| −1 | The control produces a slightly better flexibility than the tested composition |
| −2 | The control produces a better flexibility than the tested composition |

(ii) Water-absorptivity

A cotton towel treated with the soft finishing agents was cut into 3 cm ×20 cm strips. One end of each strip was dipped 2 cm into water, and the height of the water rise was measured.

EXAMPLE 1

| (Formulation) | |
|---|---|
| Di-long-chained quaternary ammonium salt prepared from primary amine and long-chained alcohol (More than 90% has an average particle size of 5 μm or smaller | 5% |
| Water | Balance |
| Total | 100% |

The results of evaluation in terms of flexibility and water adsorption of cotton towels treated by soft finishing agents of the above formulation are shown in Table 1. The table also lists the gel-liquid crystal transition points of the di-long-chained quaternary ammonium salts.

In Table 1 $R_1$ is an alkyl group derived from primary amines, and $R_2$ is an alkyl group derived from long-chained alcohol. The asterisked products in the table are those satisfying the requirements of this invention. The following description applies to the source of raw material primary amines in Table 1.

A: Amines were prepared from coconut oil fatty acid via nitril. The fraction distilled at 2 Torr and 90°–94° C. was used as the raw material.

B: Amines were prepared from tallow oil fatty acid via nitril. The fraction distilled at 2 Torr and 164°–168° C. was used as the raw material.

C: Amines were prepared from rapeseed oil fatty acid via nitril. The fraction distilled at 2 Torr and 215°–220° C. was used as the raw material.

TABLE 1

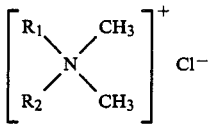

| Composition | Di-long-chained Quaternary Ammonium Salt: Raw primary Amine | Raw Long-chained Alcohol /Fractionation Conditions | Gel-Liquid Crystal Transition Point (°C.) | Treated Cotton Towel: Flexibility | Height of Water-absorption |
|---|---|---|---|---|---|
| No. 1 | A | Hydrogenated coconut oil alcohol /3 Torr, room temp.–230° C. | 23.3 | −1 | 7.9 cm |
| No. 2 | A | Hydrogenated coconut oil alcohol /3 Torr, 200–230° C. | 20.5 | −0.5 | 7.4 cm |
| No. 3* | A | Hydrogenated tallow oil alcohol /3 Torr, room temp.–250° C. | 10.9 | 0 | 11.8 cm |
| No. 4 | A | Hydrogenated fish oil alcohol /3 Torr, room temp.–230° C. | 22.9 | 0 | 7.6 cm |
| No. 5 | A | Hydrogenated fish oil alcohol /3 Torr, 200–230° C. | 21.7 | 0 | 7.1 cm |
| No. 6* | A | Hydrogenated fish oil alcohol /3 Torr, room temp.–280° C. | 12.1 | 0 | 10.7 cm |
| No. 7* | A | Hydrogenated fish oil alcohol /3 Torr, 200–280° C. | 9.5 | +0.5 | 11.2 cm |
| No. 8* | A | Hydrogenated fish oil alcohol /3 Torr, 230–280° C. | 7.5 | +0.5 | 12.1 cm |
| No. 9 | B | Hydrogenated coconut oil alcohol /3 Torr, room temp.–250° C. | 21.2 | 0 | 7.8 cm |
| No. 10* | B | Hydrogenated coconut oil alcohol /3 Torr, room temp.–210° C. | 7.3 | 0 | 10.9 cm |
| No. 11 | B | Hydrogenated tallow oil alcohol /3 Torr, room temp.–250° C. | 40.0 | 0 | 6.5 cm |
| No. 12 | C | Hydrogenated coconut oil alcohol /3 Torr, 200–250° C. | 26.5 | +0.5 | 7.9 cm |
| No. 13* | C | Hydrogenated coconut oil alcohol /3 Torr, room temp.–250° C. | 8.1 | +0.5 | 11.7 cm |
| No. 14 | Di(hydrogenated tallow oil alkyl)dimethyl ammonium chloride (Arkado 2HT, manufactured by Lion Co., Ltd. | | 41.5 | Control | 5.9 |
| No. 15 | Di(hydrogenated tallow oil alkyl)dimethyl ammonium chloride (Kotamine D-86P, manufactured by Kao Corp. | | 42.0 | Control | 5.2 |

TABLE 1-continued

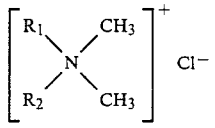

| Composition | Di-long-chained Quaternary Ammonium Salt: Raw primary Amine | Raw Long-chained Alcohol /Fractionation Conditions | Gel-Liquid Crystal Transition Point (°C.) | Treated Cotton Towel: Flexibility | Height of Water-absorption |
|---|---|---|---|---|---|
| Untreated | — | | — | — | 12.7 |

EXAMPLE 2

(Formulation)

| | |
|---|---|
| Dialkylethylmethyl ammonium ethylsulfate* | 5% |
| Ethylene glycol | 3% |
| Water | Balance |
| Total | 100% |

*Dialkylethylmethyl ammonium ethylsulfate was prepared using the primary amine A in Example 1 as a primary amine source, and tallow oil alcohol fraction distilled at 2 Torr and 215–220° C. as a raw alcohol.

Several dispersions of soft finishing agents having the same formulation as noted above, but having different average particle sizes of the active agent, were prepared by altering the temperature and rotating speed of the stirring propeller for each composition. The dispersions were stored at 25° C. for 48 hours were then subjected to the test using the cotton towel to evaluate their performance with respect to flexibility and water absorption in the same manner as in Example 1. The results are shown in Table 2. The particle size distribution of the soft finishing agents was measured using a Coulter counter (Type TA II with a 50 μm aperture tube manufactured by Coulter Electronics Co.) on the dispersions which were allowed to stand at 25° C. for 48 hours.

TABLE 2

| Composition | Size distribution: Average Particle Size (μ) | Particles with Size below 5μ | Cotton Towel Performance: Flexibility | Water-absorption |
|---|---|---|---|---|
| No. 16* | 1.3 | 98% | 0 | 11.7 cm |
| No. 17* | 2.1 | 98% | +0.5 | 11.5 cm |
| No. 18* | 3.0 | 94% | +0.5 | 11.9 cm |
| No. 19* | 4.3 | 90% | 0 | 11.7 cm |

EXAMPLE 3

(Formulation)

| | |
|---|---|
| Quaternary ammonium salt listed in Table 3 | 5% |
| Decyldimethyl amine | 0.1% |
| Water | Balance |
| Total | 100% |

More than 90% of the quaternary ammonium salt in the dispersion had diameter of not more than 5μm.

The sample dispersions were subjected to the test using cotton towel strips to evaluate their performance in terms of flexibility and water absorption in the same manner as in Example 1. The results are shown in Table 3.

TABLE 3

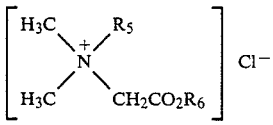

| Composition | Raw Alcohol of $R_5$/ Distillation Conditions | Raw Alcohol of $R_6$/ Distillation Conditions | Cotton Towel Performance: Gel-Liquid Crystal Transition Point (5%) | Flexibility | Height of Water Absorption (cm) |
|---|---|---|---|---|---|
| No. 20 | Hydrogenated tallow oil alcohol/ 3 Torr, 200–250° C. | Hydrogenated tallow oil alcohol/3 Torr, 200–250° C. | 45° C. | 0 | 5.5 |
| No. 21 | Hydrogenated coconut oil alcohol/ 3 Torr, room temp.–200° C. | Hydrogenated fish oil alcohol/ 3 Torr, room temp.–230° C. | 33° C. | 0 | 7.3 |
| No. 22* | Hydrogenated coconut oil alcohol/ 3 Torr, room temp.–200° C. | Hydrogenated fish oil alcohol/ 3 Torr, 200–280° C. | 11° C. | 0 | 12.5 |
| No. 23* | Hydrogenated Coconut oil alcohol/ 3 Torr, room temp.–200° C. | Hydrogenated fish oil alcohol/ 3 Torr, 250–280° C. | 16° C. | +0.5 | 12.2 |
| No. 24* | Hydrogenated Coconut oil alcohol/ 3 Torr, room temp.–200° C. | Hydrogenated tallow oil alcohol/ 3 Torr, 200–250° C. | 20° C. | 0 | 10.3 |
| No. 25 | Hydrogenated Coconut oil alcohol/ 3 Torr, room temp.–250° C. | Hydrogenated tallow oil alcohol/ 3 Torr, 200–250° C. | 41° C. | 0 | 6.9 |
| No. 26* | Hydrogenated Coconut oil alcohol/ 3 Torr, room temp.–250° C. | Hydrogenated fish oil alcohol/ 3 Torr, 250–280° C. | 26° C. | +1.0 | 9.3 |
| No. 27* | Hydrogenated tallow oil alcohol/ 3 Torr, 200–250 ° C. | Hydrogenated coconut oil alcohol/ 3 Torr, room temp.–200° C. | 19° C. | 0 | 10.0 |
| No. 28* | Hydrogenated fish oil alcohol/ 3 Torr, 250–280 ° C. | Hydrogenated coconut oil alcohol/ 3 Torr, room temp.–200° C. | 25° C. | +0.5 | 10.9 |
| No. 29 | Di-tallow oil-derived alkyl dimethyl ammonium chloride | | 42° C. | Control | 5.2 |

TABLE 3-continued

| Composition | Raw Alcohol of $R_5$/ Distillation Conditions | $\left[H_3C(H_3C)N^+(R_5)CH_2CO_2R_6\right]Cl^-$ Raw Alcohol of $R_6$/ Distillation Conditions | Cotton Towel Performance Gel-Liquid Crystal Transition Point (5%) | Flexibility | Height of Water Absorption (cm) |
|---|---|---|---|---|---|
| Untreated | — | — | — | — | 12.7 |

EXAMPLE 4

| (Formulation) | |
|---|---|
| Quaternary ammonium salt of No. 23 listed in Table 3 | 5% |
| Water | Balance |
| Total | 100% |

Several dispersions of soft finishing agents having the same formulation as noted above, but different having average particle sizes of the active agent, were prepared by altering the temperature and rotating speed of the stirring propeller for each composition. The dispersions were stored at 25° C. for 48 hours, after which they were subjected to the test using cotton towel strips to evaluate their performance concerning flexibility and water absorption in the same manner as in Example 3. The results are shown in Table 4. The particle size distribution of soft finishing agents was measured using a Coulter counter (Type TA II with a 50 μm aperture tube anufactured by Coulter Electronics Co.) on the dispersions which were allowed to stand at 25° C. for 48 hours.

TABLE 4

| Composition | Size distribution: Average Particle Size (μm) | Size distribution: Particles with Size below 5μ | Cotton Towel Performance: Flexibility | Cotton Towel Performance: Water-absorption |
|---|---|---|---|---|
| No. 1* | 1.2 | 98% | +0.5 | 12.3 cm |
| No. 2* | 1.9 | 98% | +0.5 | 12.5 cm |
| No. 3* | 2.5 | 95% | 0 | 12.7 cm |
| No. 4* | 3.7 | 91% | 0 | 12.0 cm |

EXAMPLE 5

-continued

| (Formulation) | |
|---|---|
| Quaternary ammonium salts listed in Table 5 | 5% |
| Amine and/or alcohol listed in Table 5 | Listed amount |
| Water | Balance |
| Total | 100% |

Cotton towel strips were treated in a 0.05% aqueous (Hardness 3.5° DH) solution of soft finishing agents having the above formulation at 25° C., and a bath ratio of 1/30 for 5 minutes while stirring. The flexibility and water absorption performance was evaluated in the same as described before. The results are shown in Table 5.

TABLE 5

| No. | Quaternary Ammonium Salt | $R_{11}$ | $R_{12}$ | Amount Formulated | R—OH R | Amount Formulated | Gel-Liquid Crystal Transition Point (5 wt % Dispersion) | Treated Cotton Towels Flexibility | Height of Water Absorption |
|---|---|---|---|---|---|---|---|---|---|
| 1* | No. 23 of Ex. 3 | decyl | ethyl | 0.2 | — | — | 15° C. | 0 | 12.7 cm |
| 2* | No. 23 of Ex. 3 | decyl | ethyl | 0.1 | dodecyl | 0.1 wt % | 10° C. | 0 | 12.5 cm |
| 3* | No. 23 of Ex. 3 | — | — | — | dodecyl | 0.2 wt % | 13° C. | 0 | 11.9 cm |
| 4* | No. 23 of Ex. 3 | octadecyl | methyl | 0.2 | — | — | 18° C. | 0 | 12.5 cm |
| 5* | No. 23 of Ex. 3 | octadecyl | methyl | 0.1 | decyl | 0.1 wt % | 10° C. | 0 | 12.0 cm |
| 6* | No. 23 of Ex. 3 | — | — | — | decyl | 0.2 wt % | 11° C. | 0 | 10.7 cm |
| 7* | No. 24 of Ex. 3 | octadecyl | methyl | 0.2 | — | — | 23° C. | 0 | 12.7 cm |
| 8* | No. 24 of Ex. 3 | octadecyl | methyl | 0.2 | decyl | 0.1 wt % | 16° C. | 0 | 11.9 cm |
| 9* | No. 24 of Ex. 3 | — | — | — | decyl | 0.2 wt % | 18° C. | 0 | 10.4 cm |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A soft finishing agent comprising the following di-long-chained quaternary ammonium salts (A) or (B):

(A) di-long-chained quaternary ammonium salt which is represented by formula (I):

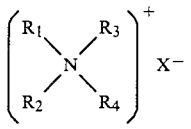

(I)

(in which $R_1$ and $R_2$ independently represent alkyl groups having an average carbon atom content of 10–24 and are derived from a naturally occurring oil or fat, provided that at least $R_1$ or $R_2$ have an average carbon atom content of not less than 14, $R_3$ and $R_4$ independently represent alkyl or hydroxyalkyl groups each having an average carbon atom content of 1–3, benzyl groups, or groups represented by $-(C_2H_4O)_nH$, wherein n denotes an integer of 1–3, and X represents a halogen or an alkyl sulfate having a carbon atom content of 1–3), and of which 5% by weight aqueous dispersion has a gel-liquid crystal transition point of not more than 20° C., or (B) di-long-chained quaternary ammonium salt which is represented by formula (II):

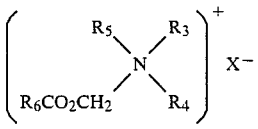

(II)

(in which $R_5$ and $R_6$ independently represent alkyl or alkenyl groups having an average carbon atom content of 10–40, provided that at least $R_5$ or $R_6$ have and average carbon atom content of not less than 16, $R_3$, $R_4$ an X have the same meanings as defined in formula (I)), and of which 5% by weight aqueous dispersion has a gel-liquid crystal transition point of not more than 30° C.

2. A soft finishing agent as claimed in claim 1, wherein said di-long-chained quaternary ammonium salt is dispersed in water, in which the particle size distribution is such that at least 90% of the dispersed quaternary ammonium salt particles are 5μm or smaller.

3. A soft finishing agent as claimed in claim 1, wherein said di-long-chained quaternary ammonium salt is that represented by formula (II) and further comprising a mono-long-chained alkyl amine, higher alcohol, or mixtures thereof, in an amount of 0.2–15% by weight base on said di-long-chained quaternary ammonium salt.

4. A soft finishing agent as claimed in claim 1, wherein said di-long-chained quaternary ammonium salt is that represented by formula (I), and either $R_1$ or $R_2$ is an alkyl group derived from hydrogenated coconut oil and the other is an alkyl group derived from hydrogenated tallow oil, hydrogenated rapeseed oil, or hydrogenated fish oil.

5. A soft finishing agent as claimed in claim 1, wherein said di-long-chained quaternary ammonium salt is that represented by formula (II), and either $R_5$ or $R_6$ is an alkyl group derived from hydrogenated coconut oil and the other is an alkyl group derived from hydrogenated tallow oil, hydrogenated rapeseed oil, or hydrogenated fish oil.

* * * * *